US005414912A

United States Patent [19]

Nielsen et al.

[11] Patent Number: 5,414,912

[45] Date of Patent: May 16, 1995

[54] SHEAR ROLLER LUBRICATING APPARATUS

[75] Inventors: Arne Nielsen, Oak Ridge; Majid Moghaddassi; Boris Vishnepolsky, both of Greensboro, all of N.C.

[73] Assignee: Guilford Mills, Inc., Greensboro, N.C.

[21] Appl. No.: 66,569

[22] Filed: May 25, 1993

[51] Int. Cl.[6] ..... D06C 13/00

[52] U.S. Cl. ..... 26/15 L; 26/1

[58] Field of Search ..... 26/15 L, 15 R, 16, 15 FB, 26/70, 1; 184/6.1, 6.17, 6.14, 7.4, 18, 19, 101

[56] References Cited

U.S. PATENT DOCUMENTS 1,092,337 4/1914 Catterall ..... 26/15 L
2,129,236 9/1938 Richardson .
2,205,617 6/1940 Coolidge .
3,013,324 12/1961 Robinson .

FOREIGN PATENT DOCUMENTS 2021673 12/1971 Germany ..... 26/15 L
2207857 8/1973 Germany ..... 26/15 L
3030217 2/1982 Germany ..... 26/15 L

*Primary Examiner*—Clifford D. Crowder
*Assistant Examiner*—Amy B. Vanatta
*Attorney, Agent, or Firm*—Shefte, Pinckney & Sawyer

[57] ABSTRACT

A shear roller lubricating apparatus for textile shearing machines having cylindrically oriented rotating shearing blades includes an oil delivery pad, an oil application pad, and an airflow-blocking plate sandwiched therebetween, the pads and the plate being mounted to an oil distribution header with the outer terminal ends of the pads projecting beyond the plate for end abutment of the pads. This assembly is mounted to the shearing machine with the outer end of the application pad arranged to tangentially contact the shearing blades. A microprocessor controlled metering pump supplies oil to the delivery pad and thereby to the application pad at selected time intervals and may be operated continuously to provide an increased supply of oil to the delivery and application pads after deactivation of the shear rollers for an extended period of time.

23 Claims, 3 Drawing Sheets

SHEAR ROLLER LUBRICATING APPARATUS

BACKGROUND OF THE INVENTION

The present invention relates broadly to textile machine lubricating apparatus and more particularly to a device for supplying oil to shearing blades attached to a rotating cylinder of a textile material shearing machine.

When processing napped and pile fabrics, the upstanding fabric loops or yarns may be mechanically cut or trimmed from the face of the fabric using a machine to shear off the fabric pile or nap. The amount of shearing varies according to the desired height of the nap or pile and on some fabrics, a very close shearing may be given. Typically, shearing machines use a rotating blade system formed as a large cylinder having two end portions and a series of very sharp curved blades which extend helically between the end portions forming the circumferential periphery of the cylinder. A ledger blade is disposed closely adjacent the periphery of the rotating cylinder and oriented so that the edges of the rotating blades pass over the edge of the ledger blade with an extremely close tolerance to produce a shearing action between the respective blades. A vertically oriented wedge-like cloth rest is provided immediately ahead of the ledger blade, with respect to the rotation of the cylinder. The fabric to be sheared is caused to travel over the cloth rest and as the fabric passes over the tip of the cloth rest, the nap is caused to "stand up" and be presented for shearing. The distance between the tip of the cloth rest and the cylindrical plane defined by the rotating blades determines the amount of shearing because during shearing, the nap projects upwardly from the tip of the cloth rest a predetermined distance into the cylindrical shearing plane. As the blades rotate into the projecting nap, the yarns are forced against the edge of the ledger blade and the portion of the yarns extending beyond the edge of the ledger blade is sheared off.

The shearing blades must remain very sharp to prevent unevenness in shearing a pile or nap. Shear marks can also result from slubs or knots that are caught or nipped by the blades of the shearing device. Shear marks show up badly when light strikes the cloth. This problem is aggravated when the blades become dull from use. Further, due to the relatively high rotational speeds of the shearing blades, heat buildup can cause the blades to become dull due to the frictional contact of the shearing blades with the ledger blade. Accordingly, the shearing blades are commonly lubricated with a suitable oil to slow the dulling process and provide a smooth and effective cut.

As may be suspected, if the shearing blades are supplied with too much oil, it can impregnate and ruin the finished fabric. If too little oil is supplied to the shearing blades, heat can build up and the aforementioned problems occur.

Additionally, shearing machines will typically employ some form of vacuum arrangement to remove cut fibers from the shearing area and this vacuum arrangement can remove oil from the blades as well as any lubricating apparatus accessible by the vacuum.

Accordingly, there exists a need for a shear roller lubricating apparatus which can apply oil to the rotating blades of a shearing machine in a controlled amount and maintain the proper lubrication level while the shearing machine is in operation and further to mitigate the effects of the vacuum arrangement on proper blade lubrication.

SUMMARY OF THE INVENTION

It is accordingly an object of the present invention to provide a shear roller lubricating apparatus which addresses the aforesaid problems. More specifically, it is an object of the present invention to provide a shear roller lubricating apparatus which applies oil to the shearing blades of a shear roller during operation thereof at a controlled rate while mitigating the effects of the aforesaid vacuum arrangement on the shear roller lubricating system. Further, it is an object of the present invention to provide a shear roller lubricating apparatus which, upon activation of the shear roller after a predetermined amount of time, can supply lubricating oil to the rollers in sufficient quantity to resupply the rollers with oil after a prolonged shut down period.

According to the present invention, a shear roller lubricating apparatus for a textile shearing machine having a generally cylindrical roller with shearing blades attached thereto includes an assembly for applying lubricating oil to the shearing blades, an arrangement for delivering the lubricating oil to the oil application assembly, and a control arrangement for selectively regulating the delivery of the lubricating oil at predetermined time intervals to the oil application assembly by the delivery arrangement for application of lubricating oil to the shearing blades during operation thereof.

According to the preferred embodiment of the present invention, the assembly for applying the lubricating oil includes an oil distribution header, an oil delivery pad mounted to the oil distribution header in oil-receiving communication therewith and an oil application pad mounted to the oil distribution header and being in oil-transferring contact with the oil delivery pad, the oil application pad being oriented for peripherally contacting the cylindrical roller at the shearing blades for application of lubricating oil thereto. The oil delivery pad and the oil application pad are disposed in localized surface abutting contact between the pads adjacent the point of contact between the oil application pad and the shearing blades. An air impermeable blocking plate is disposed intermediate the oil delivery pad and the oil application pad and mounted to the oil distribution header. The distribution header includes a plurality of oil flow passages for application of lubricating oil to the oil delivery pad at a plurality of spaced locations for generally even distribution of lubricating oil to the oil delivery pad. Preferably, the oil delivery pad and the oil application pad are each formed of felt or a similar oil absorptive material.

As previously stated, the shearing machine may include a vacuum arrangement for removal of cut fibers from the area of shear roller blades. According to the present invention, the air impermeable plate of the oil application assembly serves as a blocking arrangement for retarding withdrawal of the lubricating oil from the oil application assembly by the vacuum arrangement. Specifically, the disposition of the air impermeable plate intermediate the oil delivery pad and the oil application pad substantially blocks suction air flow through the pads. Only the outer edge portion of the oil delivery pad and the outer edge portion of the oil application pad extend beyond the plate and are in surface abutting contact for oil transfer from the delivery pad to the application pad and in turn to the shearing blades.

Preferably, the oil delivery arrangement includes a metering pump communicating with the oil application assembly for delivering the lubricating oil thereto at a selected rate. It is also preferred that the control arrangement have the capability for alternately activating and deactivating the metering pump at predetermined time intervals during operation of the shear roller and for selectively varying the predetermined time intervals, including the ability for continuously operating the metering pump. In the preferred embodiment, the control arrangement is a microprocessor or other microcontroller.

According to the preferred embodiment of the present invention, the control arrangement includes a timing device or function operable upon deactivation of the shear roller for determining whether the deactivation time of the shear roller exceeds a predetermined time period and an arrangement for continuously operating the metering pump for a predetermined time interval upon reactivation of the shear roller after the deactivation period has exceeded the predetermined time period for replenishment of the lubricating oil which was removed from the retaining and applying arrangement during deactivation of the shear roller.

DESCRIPTION OF THE PREFERRED EMBODIMENT

Figure 1:
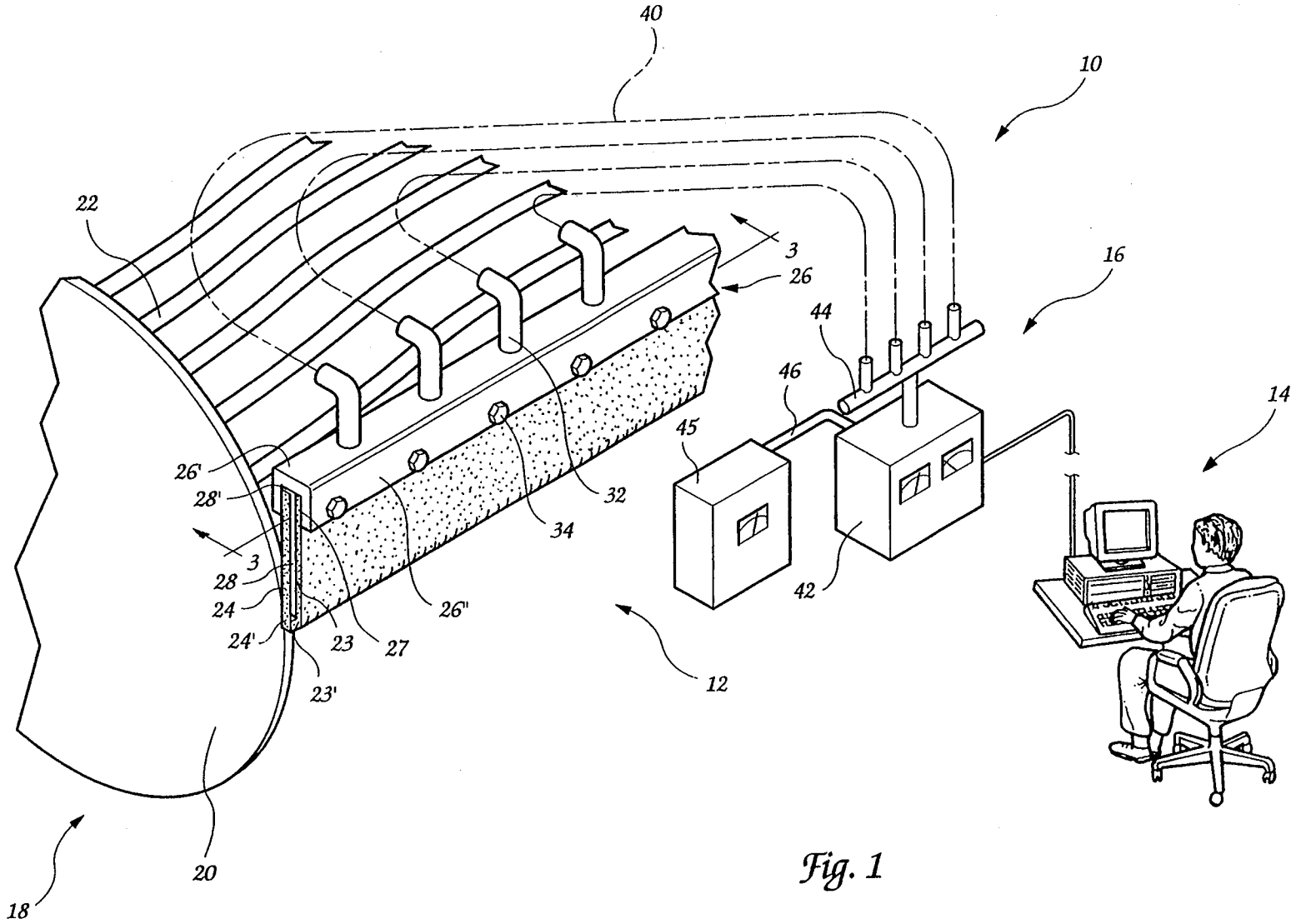
FIG. 1 is a perspective view of a shear roller lubricating apparatus according to the preferred embodiment of the present invention.

Referring now to the accompanying drawings and more particularly to FIG. 1, a shear roller lubricating apparatus for textile shearing machines according to the preferred embodiment of the present invention is indicated generally at 10 and includes an oil application assembly 12, a controller such as a microprocessor 14, and an oil delivery arrangement 16.

Textile shearing machines are well known to those persons skilled in the art and, accordingly, only the shear roller which is to be lubricated by the present invention is partially illustrated in FIG. 1, indicated generally at 18, and basically includes a pair of laterally spaced generally circular end hubs 20 between which a plurality of blades 22 extend longitudinally to form a generally cylindrical outer periphery of the shear roller 18. The blades 22 are curved in a helical fashion to provide optimal shearing engagement of the fabric by the cutting surface of the blades 22 when the blades 22 are rotating. In operation, the shear roller 18 rotates at high speed. A vacuum arrangement (not shown) is provided in the shearing machine for removal of cut fibers from the fabric shearing area.

Figure 2:
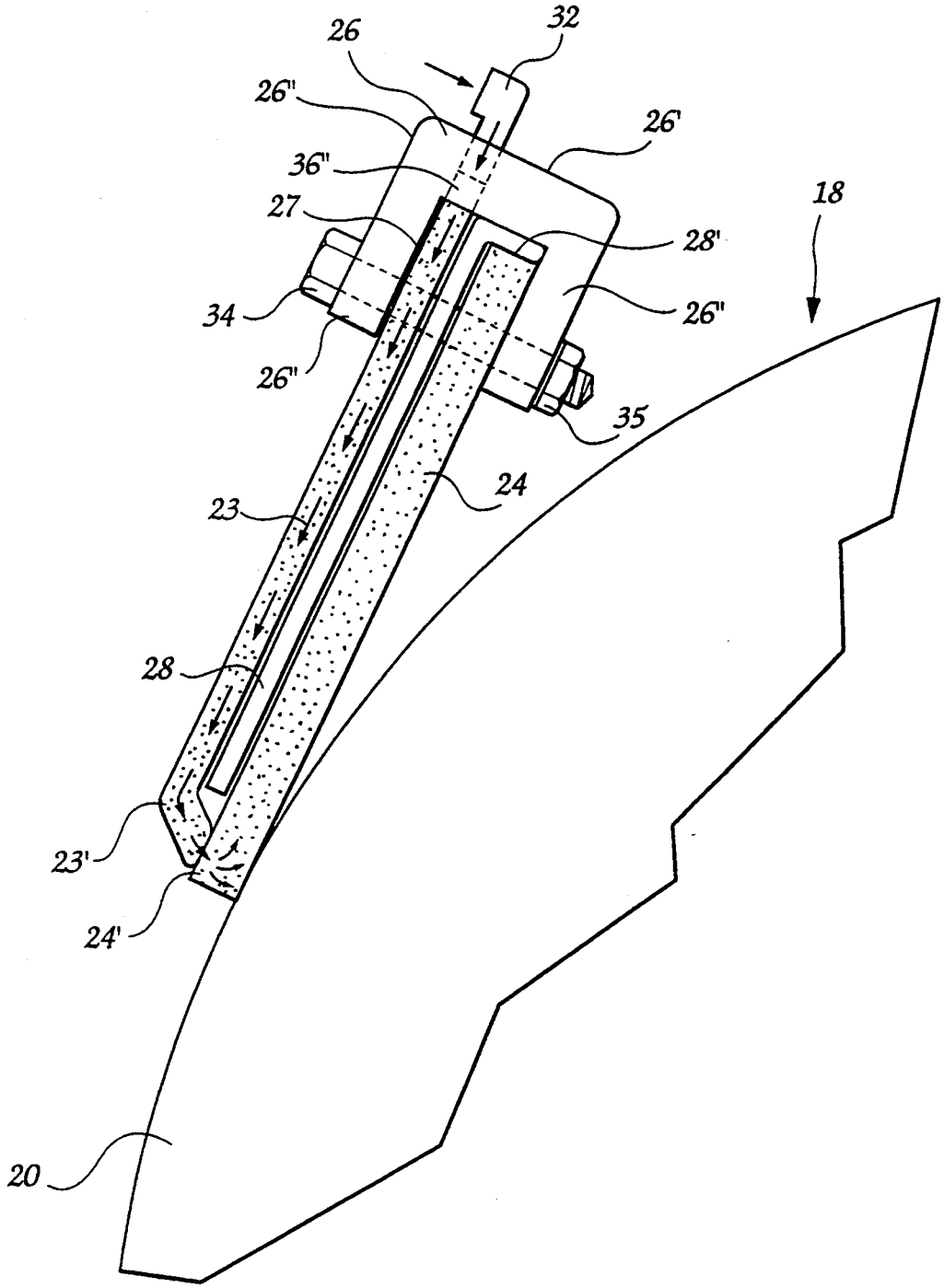
FIG. 2 is a side elevational view of the shear roller lubricating apparatus of FIG. 1.

As best seen in FIGS. 1 and 2, the oil application assembly 12 includes an oil distribution header 26, an oil delivery pad 23, an oil application pad 24, and a blocking plate 28. The oil distribution header 26 is an elongate member, generally square in overall cross section, having an upper planar surface 26' and a generally rectangular channel 27 formed in the bottom surface thereof and extending substantially the full linear extent of the header 26. The oil delivery pad 23 and the oil application pad 24 are generally planar rectangular members formed of felt or other such oil-absorbent material. One longitudinal edge of each pad 23,24 is mounted to the oil distribution header 26 in the channel 27. The blocking plate 28 is also a generally planar rectangular member which is provided for substantially blocking air flow through the pads 23,24 as will be explained in greater detail hereinafter. The blocking plate 28 is preferably formed of an air and oil impervious material such as Teflon ® produced by E. I. du Pont De Nemours and Co. of Wilmington, Del., or another suitably comparable material. The blocking plate 28 is mounted to the distribution header 26 in the channel 27 intermediate the oil delivery pad 23 and the oil application pad 24. As best seen in FIG. 2, a flange 28' is formed on the edge of the plate 28 fitted into the channel 27, extending perpendicularly outwardly therefrom. The flange 28' is positioned between the upper edge of the oil application pad 24 and the header 26 insuring separation of the application pad 24 from the delivery pad 25 and the header 26. The plate 28 is comparable in size to the pads 23,24 except that the outer edge portions 23', 24' of the pads 23,24 extend beyond the outer edge of the plate 28 and are in surface abutting contact.

The oil delivery pad 23, the plate 28, and the oil application pad 24 are all attached to the header using conventional bolts 34 which extend through aligned openings formed in the sidewalls 26'' of the header 26, the oil delivery pad 23, the plate 28, and the oil application pad 24. Conventional nuts 35 hold the bolts 34 in place. As seen in FIG. 1, the bolts 34 are arranged at spaced intervals substantially the full linear extent of the oil distribution header 26. The header 26 is supported on the frame of the shearing machine (not shown) and oriented with the oil delivery pad 23, the plate 28, and the oil application pad 24 extending angularly downwardly and outwardly from the header 26 so as to be angled away from vertical approximately 25° with the oil delivery pad at the upper extent and the oil application pad 24 in tangential, peripheral contact with the shear roller 18. The above-defined angular relationship will be explained in greater detail presently.

Figure 3:
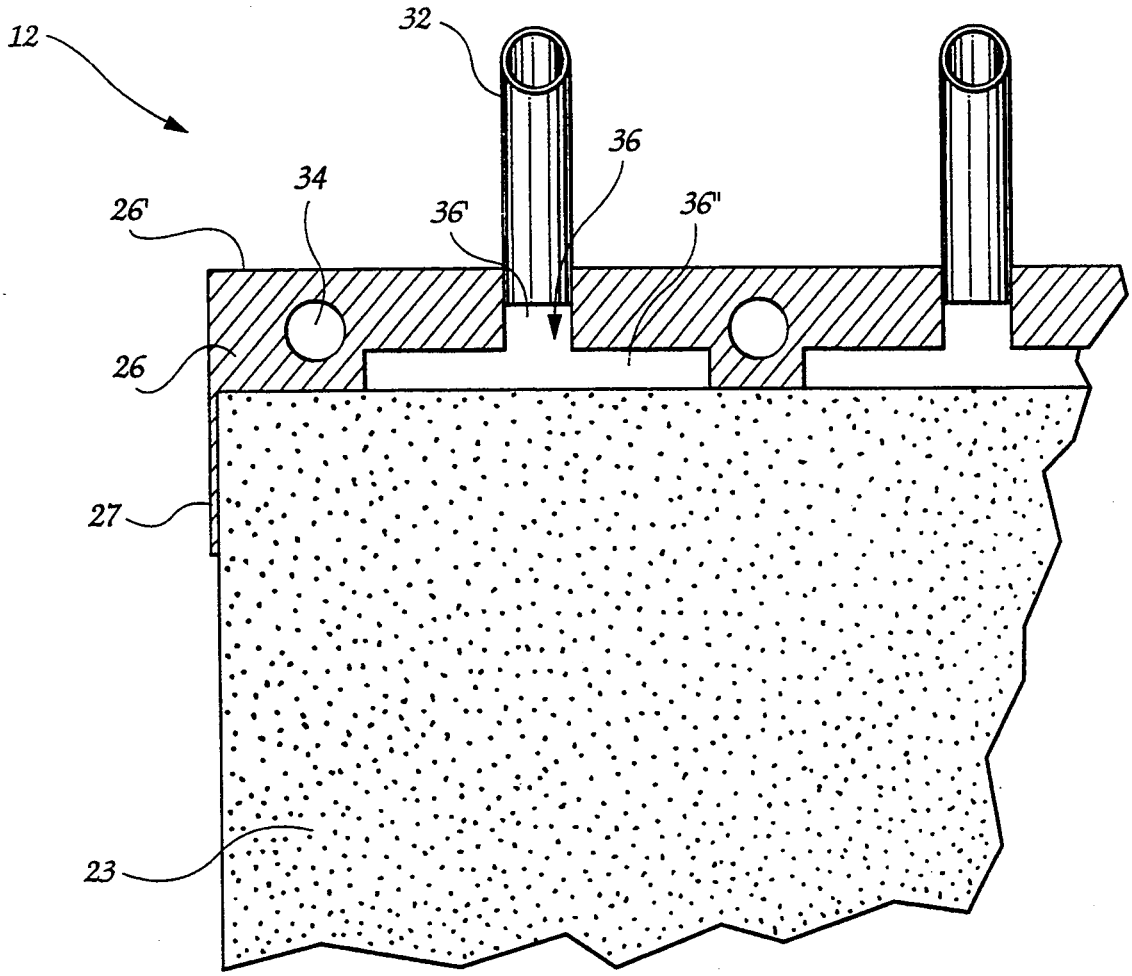
FIG. 3 is a partial cross-sectional view of the oil retaining and applying arrangement of the shear roller lubricating apparatus of the present invention, taken along lines 3—3 of FIG. 1.

With reference to FIG. 3, a portion of the oil application assembly 12 is shown in lengthwise cross-section, illustrating the header 26 construction. Oil application openings 36 are formed through the header 26 along the upper surface 26' thereof and intermediate the bolt openings 30, each oil application opening 36 having a cylindrical entrance portion 36' which extends a distance into the oil distribution header 26 and opens into an outwardly flared oil flow discharge channel portion 36''. Each oil flow discharge channel portion 36'' extends longitudinally along the header 26 from its respective oil entrance portion 36' to a position closely adjacent the two adjacent bolt openings 30 and opens into the channel 27 formed in the oil distribution header 26 immediately adjacent the upper edge of the oil delivery pad 23, to be in oil-transferring communication therewith. Oil flow fittings 32, which are generally tubular members, are mounted to the distribution header 26 at the oil application openings 36 and project outwardly therefrom. The oil fittings 32 accept oil from the oil delivery system 16 (see FIG. 1) through suitable conduits, indicated only at 40 in FIG. 1, for application to the oil delivery pad 23 which will be explained more thoroughly hereinafter.

Lubricating oil is supplied to the oil application fittings 32 from the oil delivery arrangement 16 as will be explained in greater detail hereinafter. With reference to FIG. 2, and as is shown by the directional arrows, oil thus supplied advances under pressure through the oil application fittings 32, through the entrance portions 36' thereof, and into the discharge channel portions 36'' wherein the oil contacts the upper edge of the oil delivery pad 23. From there, the oil gravitationally flows through the oil delivery pad 23 as well as being drawn thereinto by the wicking action of the absorbent oil delivery pad 23. The lubricating oil migrates continually to the terminal end portion 23' of the oil delivery pad 23 where, due to physical contact between the two absorptive pads 23,24, oil is wicked from the terminal end portion 23' of oil delivery pad 23 into the terminal end portion 24' of the oil application pad 24 adjacent the area of blade 22 contact. Due to the aforesaid 25° angular orientation of the oil application assembly 12 away from vertical, and since, in operation, the terminal end portion 23' of the oil delivery pad is laden heavily with oil, the terminal end portion 23' gravitationally sags vertically downwardly into surface abutting contact with the terminal end portion 24' of the oil application pad 24 at a position opposite the contact point of the oil application pad 24 with the blades 22 (not shown in FIG. 2) of the shear roller 18. This orientation gravitationally assists the aforesaid wicking action to further enable oil transfer from the oil delivery pad 23 to the oil application pad 24. With the terminal edge portion 24 of the oil application pad 24 in peripheral contact with the shear roller 18, its blades 22 will brush across the terminal end portion 24' of the oil application pad 24 causing a small portion of lubricating oil to be applied to the cutting edge of each blade 22, as will be explained in greater detail hereinafter.

When in use, oil is continually being removed from the oil delivery pad 23 through the oil application pad 24 primarily by the action of the blades 22 and partially the vacuum arrangement. As a result, and with reference to FIG. 1, the oil delivery pad 23 must be replenished from a central oil supply 45 to maintain sufficient lubricating oil in the oil application pad 24 for proper blade lubrication. For that purpose, the oil delivery system shown generally at 16 includes a metering pump 42, which receives oil from an oil supply 45 through conventional piping 46, and supplies the oil under pressure through a main supply manifold 44 and therefrom through individual oil supply lines 40, shown only in broken lines in FIG. 1, to the oil fittings 32. The oil metering pump 42 may be any type of pump capable of pumping oil at a controlled rate with sufficient endurance for prolonged operation with periodic start up and shut down, as will be explained in greater detail hereinafter.

The metering pump 42 is controlled by a microprocessor 14 which includes an internal timing function for regulating the duty cycle of the metering pump 42. The microprocessor 14 provides a variety of possible operating modes. For example, during the normal, ongoing shearing operation, the microprocessor can control cycling of the pump between an activated and deactivated state at predetermined time intervals to provide a replenishing supply of lubricating oil to the oil application pad 24 at a rate as necessitated by depletion of the lubricating oil from the oil delivery pad 23 and the oil application pad 24 by the blades 22 without causing excess oil buildup in either the oil delivery pad 23 or the oil application pad 24. The predetermined time intervals may be selectively varied by appropriate programming of the microprocessor 14. This operational mode serves to provide the lubricating apparatus of the present invention with the ability to supply sufficient oil to keep the blades 22 lubricated while preventing excess oil from being distributed to the oil delivery pad 23 and the oil application pad 24, which could result in oil fouling the fabric undergoing treatment by the shearing machine.

During any period of prolonged deactivation of the shearing machine, the microprocessor 14 deactivates operation of the pump 42 and the blocking plate 28 of the oil delivery arrangement 12 serves to retard and minimize oil depletion from the oil delivery pad 23 by the vacuum arrangement by largely preventing vacuum air flow through the oil delivery pad 23. Nevertheless, the action of the vacuum arrangement on the oil application pad 24 and other factors, such as drainage, act to remove oil from the oil application pad 24 and, in turn, the oil delivery pad 23. Upon reactivation of the shearing machine, oil depletion from either or both of the oil application pad 24 and the oil delivery pad 23 could result in insufficient lubrication of the shearing blades 22. Therefore, the microprocessor 14 is programmed to indicate to the operator that "pre-oiling" is recommended, prevent rotation of the blades, and allow the operator to selectively control the pump 42 to provide an increased supply of oil to the oil delivery pad 23 upon restart of the shearing machine after any deactivation exceeding a predetermined time period in order to replenish a depleted oil application pad 24. The microprocessor 14 monitors the main power supply of the shearing machine (not shown) as to whether the shearing machine is operational thereby allowing the microprocessor 14 to determine how long any given period of deactivation lasts. When the shearing machine is restarted after a period of deactivation exceeding the predetermined time period defined and monitored by the microprocessor 14, the microprocessor will act to operate the metering pump 42 continuously in a "pre-oiling" mode for a period of time to replenish the oil supply which has been removed from the oil delivery pad 23 and the oil application pad 24. After a predetermined period of time, the microprocessor 14 will revert to its operational mode and cycle the metering pump 42 in the manner previously discussed. The microprocessor 14 will also provide a warning signal to the operator under conditions of low oil level, low oil pressure, or if problems exist within the vacuum arrangement.

While it is preferred that the control be provided by a microprocessor, it is contemplated that acceptable results may be obtained using an electro-mechanical system configured to provide the necessary adjustments using switches, rheostats, or other suitable devices or apparatus.

In summary, oil supplied from the metering pump 42 is delivered through the oil supply manifold 44 and thereby distributed to the oil application assembly 12 through oil supply lines 40. The oil fittings 32 direct the oil into the header 26. Oil entering the header 26 through the oil fittings 32 is directed into the end portions 36' of the oil openings 36 and from there to the oil flow discharge channel portions 36''. The oil flow discharge channel portions 36'' distribute the oil over a wide portion of the upper edge of the oil delivery pad 23. The oil delivery pad 23 wicks oil from the oil flow discharge channel portions 36'' and by the combined effects of gravity and the aforesaid wicking action, oil is distributed throughout the oil delivery pad 23. Contact between the oil delivery pad 23 and the oil application pad 24 allows the transfer of lubricating oil to the oil application pad 24 for application to the shearing blades 22. The metering pump 42 is cycled on and off by the microprocessor 14 to provide a replenishing supply of oil at regular intervals to the oil delivery pad 23 and, ultimately, to the shearing blades 22.

By the present invention, a controlled supply of oil is provided for lubricating shear roller blades 22. By controlling the flow of oil to the oil retention and application assembly 12, sufficient lubrication is provided while eliminating the possibility of fouling the fabric being trimmed with excess oil. Further, the possibility of oil starvation is reduced by the use of the Teflon® blocking panel 28 and the felt oil pads 23,24. Additionally, during periods of known oil depletion, e.g., during start up, the present invention acts to provide an increased oil supply thereby maintaining sufficient blade lubrication under controlled conditions.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A shear roller lubricating apparatus for textile shearing machines having a generally cylindrical roller with shearing blades attached thereto, said lubricating apparatus comprising:

means for applying a lubricating oil to the shearing blades;

means for delivering the lubricating oil to said applying means; and control means for selectively regulating the delivery of the lubricating oil at predetermined time intervals to said applying means by said delivery means for application of lubricating oil to the shearing blades during operation thereof;

said oil applying means including an oil distribution header, an oil delivery pad mounted to said oil distribution header in oil receiving communication therewith, an oil application pad mounted to said oil distribution header, said oil application pad being oriented for peripherally contacting the cylindrical roller at the shearing blades for application of lubricating oil thereto, an air impermeable blocking plate disposed intermediate said oil delivery pad and said oil application pad and mounted to said oil distribution header, said oil delivery pad and said oil application pad being disposed in localized surface abutting oil transferring contact adjacent the point of contact between said oil application pad and said shearing blades.

2. A shear roller lubricating apparatus according to claim 1 wherein said distribution header includes a plurality of oil flow passages for application of lubricating oil to said oil delivery pad at a plurality of spaced locations for generally even distribution of lubricating oil to said oil delivery pad.

3. A shear roller lubricating apparatus according to claim 1 wherein said oil application pad and said oil delivery pad are each formed of felt.

4. A shear roller lubricating apparatus according to claim 1 wherein the shearing machine includes a vacuum arrangement for removal of cut fibers from the shear roller and said blocking plate is operative for retarding withdrawal of the lubricating oil from said applying means by the vacuum arrangement.

5. A shear roller lubricating apparatus according to claim 1 wherein said oil delivery means includes a metering pump communicating with said oil applying means for delivering the lubricating oil thereto at a selected rate.

6. A shear roller lubricating apparatus according to claim 5 wherein said control means includes means for alternately activating and deactivating said metering pump at predetermined time intervals during operation of said shear roller.

7. A shear roller lubricating apparatus according to claim 6 wherein said control means further includes means for selectively varying said predetermined time intervals.

8. A shear roller lubricating apparatus according to claim 6 wherein said control means includes means for continuously operating said metering pump.

9. A shear roller lubricating device according to claim 1 wherein said control means includes a microprocessor.

10. A shear roller lubricating apparatus for textile shearing machines having a generally cylindrical roller with shearing blades attached thereto and a vacuum arrangement for removal of cut fibers from the shear roller, said lubricating apparatus comprising:

means for applying a lubricating oil to the shearing blades;

means for delivering the lubricating oil to said applying means; and control means for selectively regulating the delivery of the lubricating oil at predetermined time intervals to said applying means by said delivery means for application of lubricating oil to the shearing blades during operation thereof;

said applying means including an oil application pad and an oil delivery pad in communication therewith, one side of said oil application pad being in lubricating contact with said shearing blades, and blocking means for retarding withdrawal of the lubricating oil from said applying means by the vacuum arrangement, said blocking means including a substantially air-impermeable plate disposed intermediate said oil delivery pad and said oil application pad for substantially blocking air flow through said pads with a portion of said oil delivery pad and a portion of said oil application pad extending beyond said plate, said extending portions of said oil delivery pad and said oil application pad being in surface abutting contact for oil transferring therebetween.

11. A shear roller lubricating apparatus for textile shearing machines having a generally cylindrical roller with shearing blades attached thereto, said lubricating apparatus comprising:

means for applying a lubricating oil to the shearing blades;

means for delivering the lubricating oil to said applying means, said oil delivery means including a metering pump communicating with said oil applying means for delivering the lubricating oil thereto at a selected rate; and control means for selectively regulating the delivery of the lubricating oil at predetermined time intervals to said applying means by said delivery means for application of lubricating oil to the shearing blades during operation thereof, said control means including means for alternately activating and deactivating said metering pump at predetermined time intervals during operation of said shear roller, timing means operable upon deactivation of said shear roller for determining whether deactivation of said shear roller exceeds a predetermined time period, and means for continuously operating said metering pump for a predetermined time interval when said shear roller is activated after a deactivation period has exceeded said predetermined time period for replenishing said lubricating oil which was removed from said applying means during deactivation of said shear roller.

12. A shear roller lubricating apparatus according to claim 11 wherein said means for applying the lubricating oil includes an oil distribution header and an oil delivery pad mounted to said oil distribution header in oil receiving communication therewith.

13. A shear roller lubricating apparatus according to claim 12 wherein said means for applying the lubricating oil further includes an oil application pad mounted to said oil distribution header and being in oil-transferring contact with said oil delivery pad, said oil application pad being oriented for peripherally contacting the cylindrical roller at the shearing blades for application of lubricating oil thereto.

14. A shear roller lubricating apparatus according to claim 13 wherein said oil delivery pad and said oil application pad are disposed in localized surface abutting contact adjacent the point of contact between said oil application pad and said shearing blades.

15. A shear roller lubricating apparatus according to claim 14 and further comprising an air impermeable blocking plate disposed intermediate said oil delivery pad and said oil application pad and mounted to said oil distribution header.

16. A shear roller lubricating device according to claim 11 wherein said control means includes a microprocessor.

17. A shear roller lubricating apparatus for textile shearing machines having a generally cylindrical roller with shearing blades attached thereto, said lubricating apparatus comprising:

an oil distribution header;

an oil delivery pad mounted to said oil distribution header;

an oil application pad mounted to said oil distribution header, said oil application pad being oriented for peripherally contacting the cylindrical roller at the shearing blades for application of lubricating oil thereto, one side of said oil application pad being in contact with the shearing blades;

a substantially air impermeable plate disposed intermediate said oil delivery pad and said oil retention pad in surface abutment therewith for substantially blocking air flow through said pads, with a portion of said delivery pad and a portion of said application pad extending beyond said plate for surface abutting contact between said delivery pad and said application pad; and means communicating with said oil distribution header for delivering a lubricating oil thereto at a selected rate.

18. A shear roller lubricating apparatus according to claim 17 wherein said means for delivering oil includes a metering pump.

19. A shear roller lubricating apparatus according to claim 18 and further comprising control means for alternately activating and deactivating said metering pump at predetermined time intervals during the operation of the shear roller.

20. A shear roller lubricating apparatus according to claim 19 wherein said control means further includes means for selectively varying said predetermined time intervals.

21. A shear roller lubricating apparatus according to claim 19 wherein said control means includes means for continuously operating said metering pump.

22. A shear roller lubricating apparatus according to claim 18 wherein said control means includes timing means operable upon deactivation of said shear roller for determining whether deactivation of said shear roller exceeds a predetermined time period, and means for continuously operating said metering pump for a predetermined time interval when said shear roller is activated after a deactivation period has exceeded said predetermined time period for replenishing of said lubricating oil which was removed from said oil application pad during deactivation of said shear roller.

23. A shear roller lubricating apparatus according to claim 18 wherein said control means includes a microprocessor.

* * * * *

UNITED STATES PATENT AND TRADEMARK OFFICE

CERTIFICATE OF CORRECTION

PATENT NO. : 5,414,912

DATED : May 16, 1995

INVENTOR(S) : Arne Nielsen, Majid Moghaddassi, and Boris Vishnepolsky

It is certified that error appears in the above-identified patent and that said Letters Patent is hereby corrected as shown below:

Column 5, line 30, delete "terminal edge portion 24" and insert therefor -- terminal edge portion 24' --.

Column 10, lines 18-19, delete "oil retention pad" and insert therefor -- oil application pad --.

Signed and Sealed this

Ninth Day of April, 1996

Bruce Lehman

*Attest:*

BRUCE LEHMAN

*Attesting Officer*

*Commissioner of Patents and Trademarks*